US011092400B2

(12) United States Patent
Moller et al.

(10) Patent No.: US 11,092,400 B2
(45) Date of Patent: Aug. 17, 2021

(54) SHOTGUN CHOKE ASSEMBLIES AND FIREARM SUPPRESSOR ASSEMBLIES AND METHODS CONNECTING THE SAME

(71) Applicant: JESS BRILEY MANUFACTURING COMPANY, Houston, TX (US)

(72) Inventors: Clifford Moller, Katy, TX (US); Marcos Monsalvo, Katy, TX (US); Claudio Salassa, Missouri City, TX (US); Robby Baldridge, Baytown, TX (US); Julio Schmidt, Katy, TX (US)

(73) Assignee: Jess Briley Manufacturing Company, Houston, TX (US)

( * ) Notice: Subject to any disclaimer, the term of this patent is extended or adjusted under 35 U.S.C. 154(b) by 64 days.

(21) Appl. No.: 16/547,379

(22) Filed: Aug. 21, 2019

(65) Prior Publication Data

US 2020/0072573 A1 Mar. 5, 2020

Related U.S. Application Data

(60) Provisional application No. 62/720,759, filed on Aug. 21, 2018.

(51) Int. Cl.
*F41A 21/00* (2006.01)
*F41A 21/32* (2006.01)
*F41A 21/40* (2006.01)

(52) U.S. Cl.
CPC ..... *F41A 21/325* (2013.01); *F41A 21/40* (2013.01)

(58) Field of Classification Search
CPC ..... F41A 21/30; F41A 21/325; F41A 21/40; F41A 21/34; F41A 21/36; Y10T 29/49826
USPC ..... 89/14.4, 14.05; 181/223; 29/428; 42/79, 90, 76.01
See application file for complete search history.

(56) References Cited

U.S. PATENT DOCUMENTS 3,045,378 A * 7/1962 Denaux ..... F41A 21/40 42/79
3,233,924 A * 2/1966 Stanley ..... F16L 19/10 285/322
3,980,325 A * 9/1976 Robertson ..... F16L 19/08 285/249
4,127,224 A * 11/1978 Newman, Sr. ..... B23B 31/18 226/196.1
4,386,477 A 6/1983 Briley
(Continued)

OTHER PUBLICATIONS

International Search Report and Written Opinion dated Oct. 29, 2019 (issued in PCT Application No. PCT/US2019/047556) [10 pages].

(Continued)

*Primary Examiner* — Michael D David
(74) *Attorney, Agent, or Firm* — Michael S. McCoy; Amatong McCoy LLC

(57) ABSTRACT

A tubular assembly for attaching accessories to gun barrels. The assembly includes a first tubular, including first interior threads on an interior surface thereof and a collet on a first end thereof. The assembly includes a second tubular, including first exterior threads on an exterior surface thereof. The first exterior threads mate with the first interior threads. The second tubular includes a ridge of knurls on the exterior surface thereof. The ridge of knurls is adapted to frictionally engage the collet when the first tubular and the second tubular are assembled.

19 Claims, 12 Drawing Sheets

(56) References Cited

U.S. PATENT DOCUMENTS 4,510,843 A * 4/1985 Rabatin ..... F41A 21/325 89/14.4
4,575,274 A * 3/1986 Hayward ..... F16D 9/08 174/75 C
4,807,911 A * 2/1989 Short ..... F16L 37/0925 285/323
5,814,757 A 9/1998 Buss
6,213,149 B1 * 4/2001 Moner ..... F16K 5/0414 137/556.3
6,293,595 B1 * 9/2001 Marc ..... F16L 19/005 285/86
6,511,099 B2 * 1/2003 Bartholoma ..... F16L 37/008 285/140.1
6,688,651 B2 * 2/2004 Min-Cheol ..... F16L 19/005 285/92
6,722,704 B2 * 4/2004 Bartholoma ..... F16L 41/14 285/140.1
6,929,032 B2 * 8/2005 Rehder ..... F16K 27/003 137/884
7,354,079 B2 * 4/2008 Rehder ..... F16L 37/091 285/307
7,410,193 B2 * 8/2008 Guest ..... F16L 37/0925 285/322
7,837,346 B2 * 11/2010 Griffin ..... F41G 1/35 362/191
8,079,314 B2 * 12/2011 MacLean ..... F16B 12/2027 108/158.11
8,641,099 B2 * 2/2014 Cuva ..... F02C 7/222 285/124.4
8,978,286 B2 3/2015 Schafer
9,151,427 B2 * 10/2015 Imanishi ..... F16L 35/00
9,342,077 B2 * 5/2016 Nguyen ..... F16K 27/0281
9,371,947 B2 * 6/2016 Choi ..... F16L 19/065
9,440,246 B2 * 9/2016 Meehan ..... B05B 15/65
9,500,427 B1 * 11/2016 Larue ..... F41A 21/30
9,835,276 B2 * 12/2017 Wu ..... F16L 37/08
10,550,969 B2 * 2/2020 Shorrock ..... F16L 19/0206
2004/0045209 A1 3/2004 Nielsen
2004/0100097 A1 * 5/2004 Fukano ..... F16L 47/041 285/322
2007/0267869 A1 11/2007 Patel
2010/0090456 A1 * 4/2010 Halaczkiewicz ... F16L 19/0212 285/12
2010/0275492 A1 11/2010 Moller et al.
2014/0237881 A1 8/2014 Mack
2016/0097609 A1 4/2016 Penchuk

OTHER PUBLICATIONS

International Preliminary Report on Patentability issued in PCT Application No. PCT/US2019/047556, dated Mar. 4, 2021; 9 pages.

* cited by examiner

SHOTGUN CHOKE ASSEMBLIES AND FIREARM SUPPRESSOR ASSEMBLIES AND METHODS CONNECTING THE SAME

CROSS-REFERENCE TO RELATED APPLICATIONS

The present application claims the benefit of U.S. Provisional Patent Application No. 62/720,759, filed on Aug. 21, 2018, entitled "TUBULAR ASSEMBLY AND METHOD OF CONNECTING TUBULARS", the entirety of which is incorporated herein by reference as if set out in full.

FIELD

The present disclosure relates to tubular assemblies and to methods of connecting together two lengths of tubular.

BACKGROUND

There are many situations in which connection of tubulars is required. One situation arises in firearms applications, particularly in connecting a shotgun choke to the barrel of a shotgun. Chokes constrict the muzzle end of a barrel to modify the trajectory of shot as it is expelled from the barrel. Chokes are used in various firearm applications, including target shooting, game bird hunting, and clay pigeons shooting. Many chokes are screw-in chokes that attach directly to the barrel or to an insert that is attached to the barrel via threading.

Another common situation that arises in firearm applications is in the connecting of a suppressor, such as to a rifle or pistol barrel. Suppressors may be used to reduce noise pollution and to protect hearing. A suppressor (also referred to as a silencer, sound suppressor, and sound moderator) is typically connected with the barrel of a firearm.

Regardless of the particular application, often tubulars are connected together using threaded connections (i.e., the tubulars are screwed together). Applications in which the tubulars are subjected to high forces, such as firearm applications, often use a large number of screw threads to provide for a connection between the tubulars that is sufficiently strong to withstand the high forces involved. However, large numbers of screw threads correspondingly require a large number of turns of the tubulars in order to screw one tubular onto the other tubular. Such a threading arrangement increases the time and effort required in order to connect the tubulars together in a sufficiently strong manner.

BRIEF SUMMARY

Some embodiments include a tubular assembly. The assembly includes a first tubular and a second tubular. The first tubular includes an interior surface, an exterior surface, a first end, and a second end. The interior and exterior surfaces at least partially define a bore through the first tubular extending from the first end to the second end. First interior threads are on the interior surface of the first tubular, and a collet on the first end of the first tubular. The second tubular includes an interior surface, an exterior surface, a first end, and a second end. The interior and exterior surfaces at least partially define a bore through the second tubular extending from the first end to the second end. First exterior threads are on the exterior surface of the second tubular, and knurls on the exterior surface of the second tubular. When the first tubular and the second tubular are assembled, the first exterior threads are threadably mated with the first interior threads and the collet is engaged with the knurls.

Other embodiments include a shotgun and shotgun choke assembly. The assembly includes a shotgun having a barrel, and a shot gun choked attachable to the barrel. The barrel includes threads on an interior surface of the barrel, and a collet on a muzzle of the barrel. The shotgun choke includes an interior surface, an exterior surface, a first end, and a second end. The interior and exterior surfaces at least partially define a bore through the shotgun choke extending from the first end to the second end. First exterior threads are on the exterior surface of the shotgun choke. A ridge of a plurality of knurls are on the exterior surface of the shotgun choke. When the barrel and the shotgun choke are assembled, the first exterior threads are threadably mated with the threads on the barrel and the collet is engaged with the ridge.

Another embodiment includes a gun and suppressor assembly. The assembly includes a gun and a suppressor that is attachable to the gun. The gun includes a barrel having threads on an exterior surface thereof. A ridge is on a muzzle of the barrel, and includes a plurality of knurls. The suppressor includes an interior surface, an exterior surface, a first end, and a second end. The interior and exterior surfaces at least partially define a bore through the suppressor extending from the first end to the second end. A collet is on the first end of the suppressor, and interior threads are on the interior surface of the suppressor. When the suppressor and the barrel are assembled, the threads of the barrel are threadably mated with the threads of the suppressor, and the collet is engaged with the ridge.

One embodiment the present disclosure includes a tubular assembly. The tubular assembly includes a first tubular connected to a second tubular. The first tubular includes first interior threads on an interior surface thereof, and a collet on a first end thereof. The second tubular includes first exterior threads on an exterior surface thereof. The first exterior threads are threadably mateable with the first interior threads. The second tubular also includes knurls on the exterior surface thereof. The knurls are engageable (e.g., frictionally and/or lockingly engageable) with the collet when the first tubular and the second tubular are assembled. When the knurls are engaged with the collet, the first and second tubulars are lockingly engaged.

Another embodiment of the present disclosure includes a first tubular that includes first interior threads on an interior surface thereof that are threadably mateable with another tubular, and a collet on a first end thereof. The first tubular includes second exterior threads formed on exterior surface thereof that are threadably mateable with another tubular, such as a shotgun barrel. The collet includes a plurality of collet tabs, with collet slots positioned between adjacent collet tabs. Each collet tab includes a collet ramp surface and a collet locking surface. The collet slots allow for spring action of the collet tabs.

Another embodiment of the present disclosure includes a second tubular. The second tubular includes first exterior threads on an exterior surface thereof, and knurls on the exterior surface thereof. Each knurl includes a knurl ramp surface and a knurl locking surface. The first exterior threads are multi-lead threads with a low pitch. A gripping surface is formed on a body of the second tubular proximate a second end thereof.

Another embodiment of the present disclosure includes an assembly of a shotgun choke adapter connected with a shotgun choke insert. The shotgun choke adapter includes first interior threads on an interior surface thereof, and a collet on a first end thereof. The shotgun choke insert includes first exterior threads on an exterior surface thereof. The first exterior threads are threadably mateable with the first interior threads. The shotgun choke insert also includes knurls on the exterior surface thereof. The knurls are frictionally engageable with the collet when the shotgun choke adapter and the shotgun choke insert are assembled together.

Another embodiment of the present disclosure includes an assembly of a firearm suppressor connected with a thread adapter. The firearm suppressor includes first interior threads on an interior surface thereof, and a collet on a first end thereof. The thread adapter includes first exterior threads on an exterior surface thereof. The first exterior threads are threadably mateable with the first interior threads. The thread adapter also includes knurls on the exterior surface thereof. The knurls are frictionally engageable with the collet when the firearm suppressor and the thread adapter are assembled together.

Another embodiment of the present disclosure includes a method of assembling tubulars. The method includes threading a first tubular and a second tubular together at least until a collet on the first tubular is frictionally engaged with knurls on the second tubular.

BRIEF DESCRIPTION OF THE DRAWINGS

So that the manner in which the features and advantages of the systems, apparatus, products, and/or methods may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Systems, apparatus, products, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain embodiments of the present disclosure include a tubular assembly. The tubular assembly may be an assembly of a first tubular with a second tubular. In some such embodiments, the tubular assembly is an assembly of a shotgun barrel or shotgun choke adapter with a shotgun choke insert. In other embodiments, the tubular assembly is an assembly of a firearm suppressor with a firearm barrel or an adapter coupled to a firearm barrel. One skilled in the art would understand that, while the tubular assemblies shown and described herein are assemblies of shotgun chokes or suppressors for attachment onto firearms, the tubular assembly and associated method of use is not limited to these particular applications, and may be applied to the connection of any variety of tubulars for assembly thereof. In some embodiments, the tubular assembly and method of assembling tubulars, as disclosed herein, is suitable for use for wrench-less connections of tubulars. That is, the tubulars of the tubular assembly may be coupled (e.g., threadably mated) without use of a wrench.

Shotgun Choke Assembly

FIGS. 1A-3E depict a tubular assembly, and portions thereof, in accordance with certain embodiments of the present disclosure. The tubular assembly of FIGS. 1A-3E includes a shotgun choke adapter and a shotgun choke insert.

In use, the shotgun choke adapter may be coupled (e.g., threadably mated) with a barrel of shotgun, and the shotgun choke insert may be coupled (e.g., threadably mated) with the shotgun choke adapter. The shotgun choke adapter and shotgun choke insert coupled on the shotgun barrel form a shotgun choke thereon.

Figure 1A:
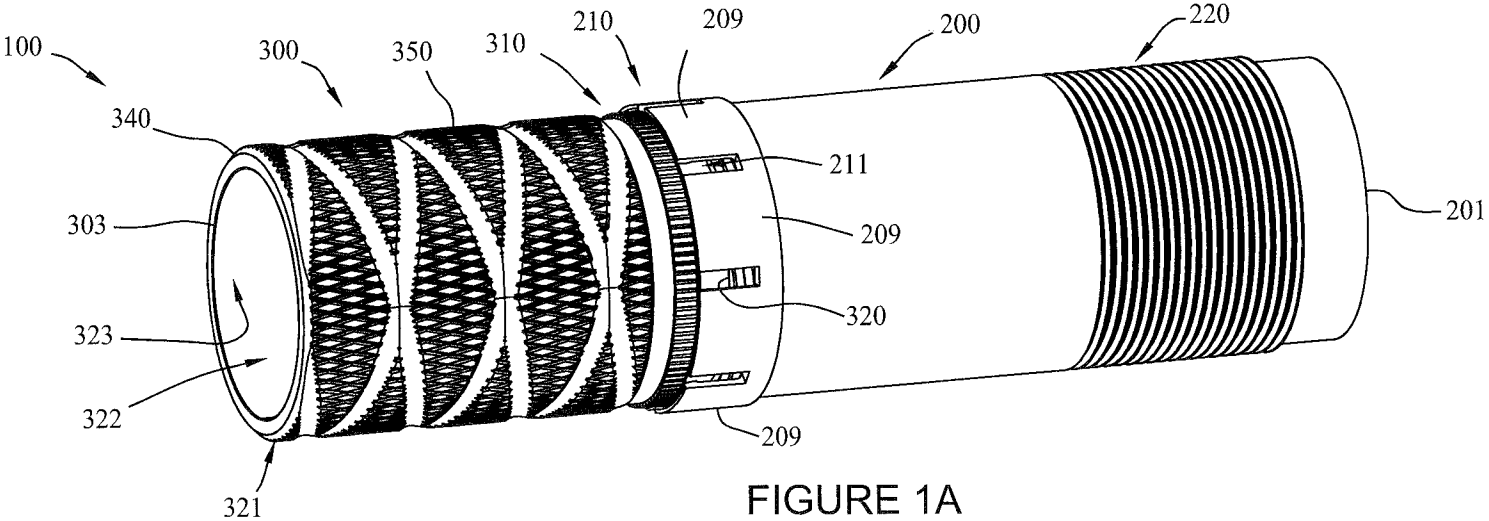
FIG. 1A is a perspective view of a tubular assembly of a shotgun choke insert with a shotgun choke adapter.
Figure 1B:
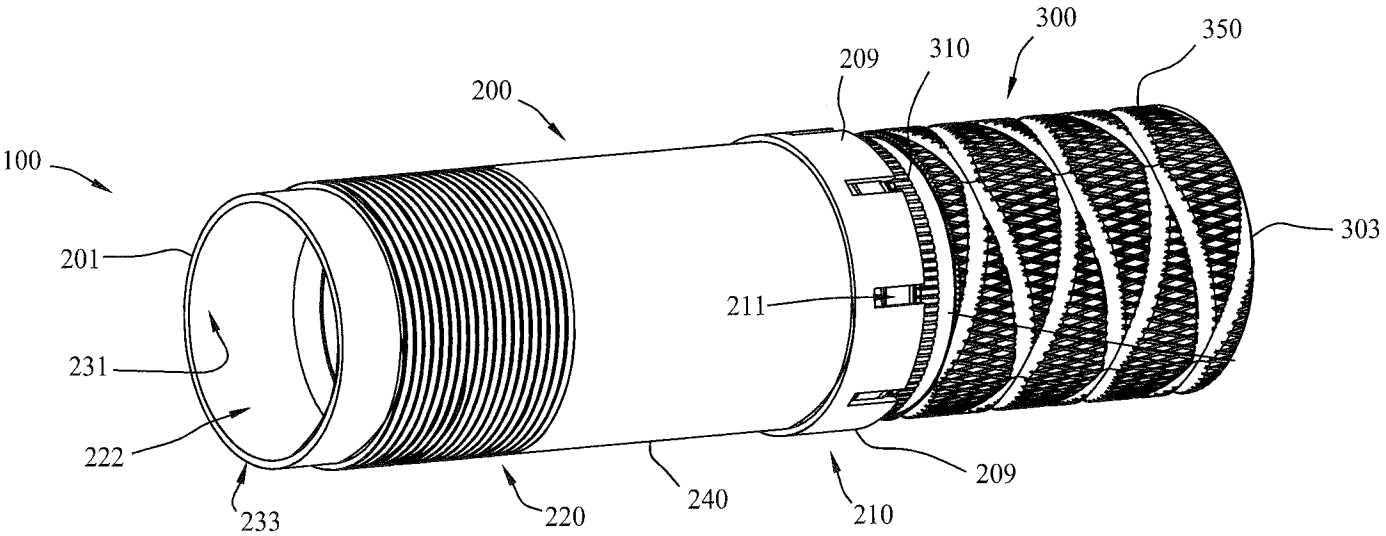
FIG. 1B is another perspective view of the tubular assembly of FIG. 1A.

With reference to FIGS. 1A and 1B, tubular assembly 100 includes first tubular 200, a shotgun choke adapter, coupled with second tubular 300, a shotgun choke insert. Tubular assembly 100 may be composed of metal (e.g., steel) or any other material suitable to the particular application. Each of first tubular 200 and second tubular 300 are shown as generally cylindrical, hollow tubulars. However, one skilled in the art would understand that the present disclosure is not limited to such tubulars.

Shotgun Choke Insert

With reference to FIGS. 1A-2E, second tubular 300 includes body 340. Body 340 has interior surface 323 and exterior surface 321, defining bore 322 through body 340.

Second tubular includes threads 320 on exterior surface 321. Second tubular 300 also includes knurling 310 (also referred to as locking feature). Knurling 310 is a structure capable of engaging with a collet on first tubular 200 such that first tubular 200 and second tubular 300 are locked together. In some embodiments, as shown in FIGS. 1A-2E, knurling 310 is or includes a ridge of knurls 311 on exterior surface 321. The plurality of knurls 311 may be arranged in a series, and may extend about an entirety or less than an entirety of a circumference of body 340.

Figure 2B:
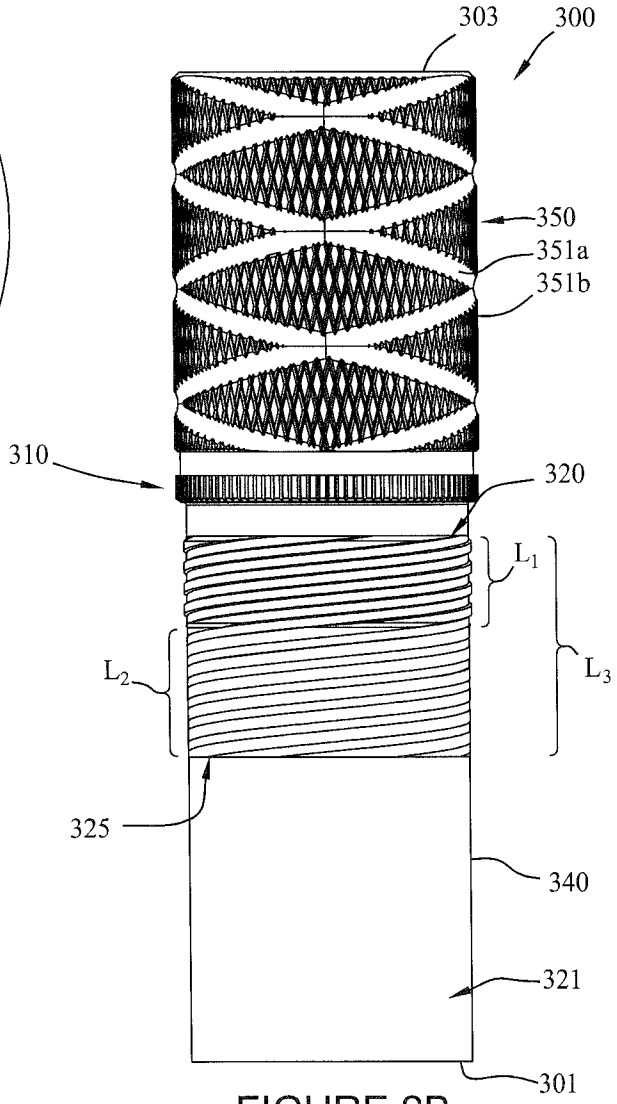
FIG. 2B is a side view of the shotgun choke insert of FIG. 2A.
Figure 2A:
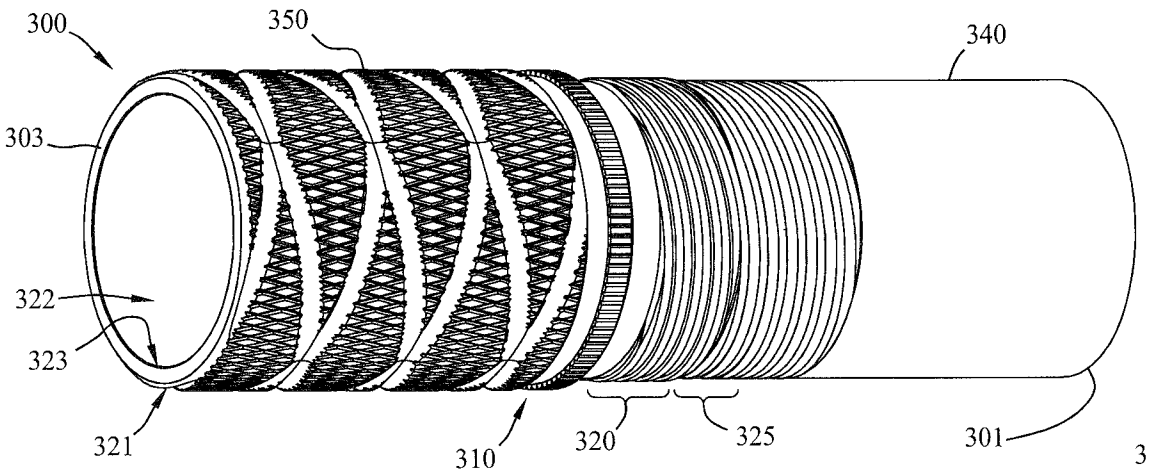
FIG. 2A is a perspective view of the shotgun choke insert of FIG. 1A.
Figure 2C:
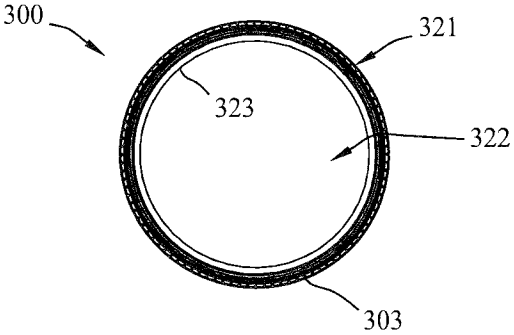
FIG. 2C is an end view of the shotgun choke insert of FIG. 2A.
Figure 2E:
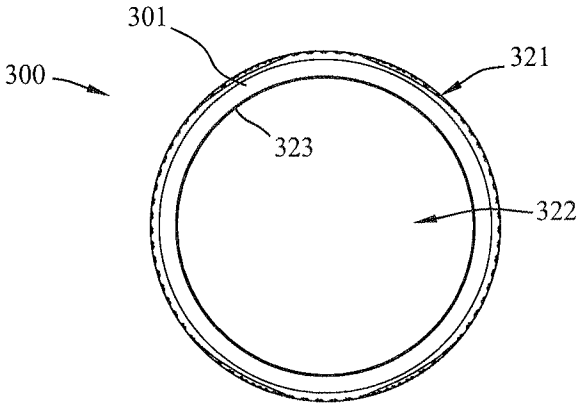
FIG. 2E is another end view of the shotgun choke insert of FIG. 2A.
Figure 2D:
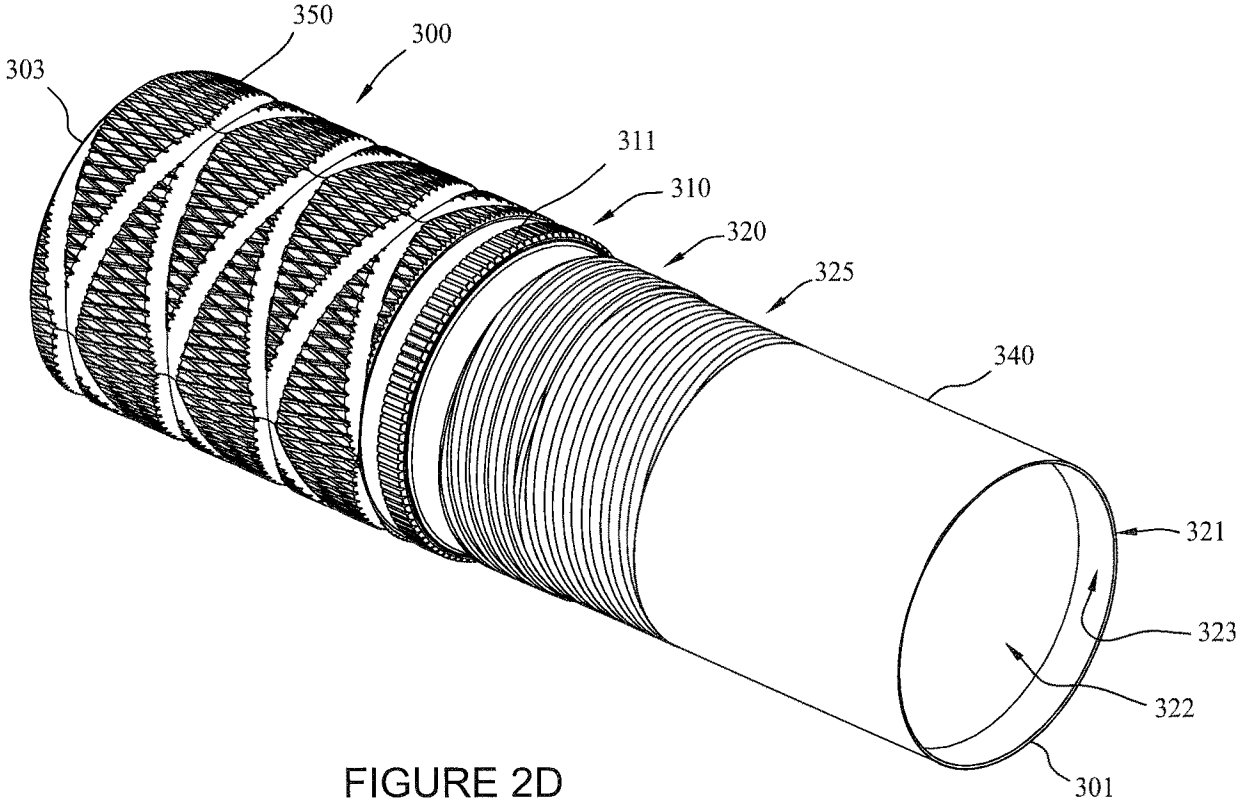
FIG. 2D is another perspective view of the shotgun choke insert of FIG. 2A.

Second tubular 300 includes gripping surface 350 on body 340, proximate second end 303 of second tubular 300. Gripping surface 350 provides a surface for users to grip second tubular 300, such as when connecting second tubular 300 to first tubular 200. Gripping surface 350 may also provide an aesthetic feature to second tubular 300. Gripping surface 350 may be or include knurling or another textured or roughened surface. In some embodiments, gripping surface 350 includes more than one surface texture. For example, as indicated in FIG. 2B, gripping surface 350 includes a relatively smooth textured portion, smooth surface 351*a*, and a relatively rough textured portion (relative to the relatively smooth textured portion), roughened surface 351*b*. Gripping surface 350 is not limited to the particular type or arrangement of surface texturing shown in FIGS. 1A-2E, and may include other textures and surface features. Gripping surface 350 may include at least one surface texture or feature that increases friction between a user's hand that is gripping second tubular 300 at gripping surface 350, such that gripping surface 350 provides for easier gripping and turning of second tubular 300.

As described in more detail below, first end 301 of second tubular 300 is insertable within the bore 222 of first tubular 200, such that threads 320 threadably engaged (mate with) threads 230, and such that collet 210 of first tubular 200 frictionally and/or lockingly engage knurling 310.

Second tubular 300 includes cosmetic threads 325 on exterior surface 321 thereof. As used herein a "cosmetic thread" is a surface feature (e.g., texture or visible ornamentation) that appears to be threading, but does not function as threading (i.e., is not threadably engageable with opposing threading). For example, the cosmetic threads disclosed herein may be or include a surface texture or surface ornamentation that has the visual appearance of threads, but does not function as threading. In some embodiments, the cosmetic threads disclosed herein may be or include a surface texture or surface ornamentation that has the tactile feel of threads, but does not function as threading. Cosmetic threads 325 are positioned adjacent threads 320, and are designed to aesthetically appear to be integral with and a continuation of threads 320. Thus, cosmetic threads 325 may provide a visual illusion that threads 320 extend over a longer length of second tubular 300 than the actual length of threads 320 on second tubular 300. With reference to FIG. 2B, threads 320 extend along second tubular 300 by distance $L_1$. Cosmetic threads 325 extend along second tubular 300 by distance $L_2$. However, because cosmetic threads 325 are positioned adjacent threads 320 and are designed to aesthetically appear to be integral with and a continuation of threads 320, a user looking at second tubular 300 may believe that second tubular 300 includes threads that extend by distance $L_3$, which is equivalent to $L_1+L_2$ (i.e., $L_1+L_2=L_3$). While threads 320 are of sufficient length to couple with a shotgun barrel or insert therein with sufficient strength to stay coupled therewith during firing of the shotgun, such a visual illusion can instill a sense of confidence in users that threads 320 have sufficient strength to hold second tubular 300 onto a shotgun barrel during use of the shotgun. Cosmetic threads 325 are not functional threads, such that cosmetic threads 325 do not and cannot mate with other threads. In some embodiments, second tubular 300 does not include cosmetic threads 325.

Shotgun Choke Adapter

With reference to FIGS. 1A, 1B and 3A-3E, first tubular 200 includes body 240. Body 240 has first end 201, second end 203, interior surface 231 and exterior surface 233, together defining bore 222 through body 240.

First tubular 200 includes threads 230 formed on interior surface 231 thereof. Threads 230 are formed at or proximate second end 203 of first tubular 200. Threads 230 are threadably engageable with threads 320 formed on exterior surface 321 of second tubular 300 when first tubular 200 and second tubular 300 are assembled together. While not shown, first tubular 200 can include cosmetic threads adjacent threads 230 and positioned appear to be integral with threads 230, such that threads 230 appear to extend for a greater distance.

First tubular 200 includes threads 220 formed on exterior surface 233 of first tubular 200, proximate a first end 201 thereof. Treads 220 are threadably engageable with a shotgun barrel (not shown) via mating threads 220 with threads that are formed on an interior surface of a shotgun barrel.

Figure 3B:
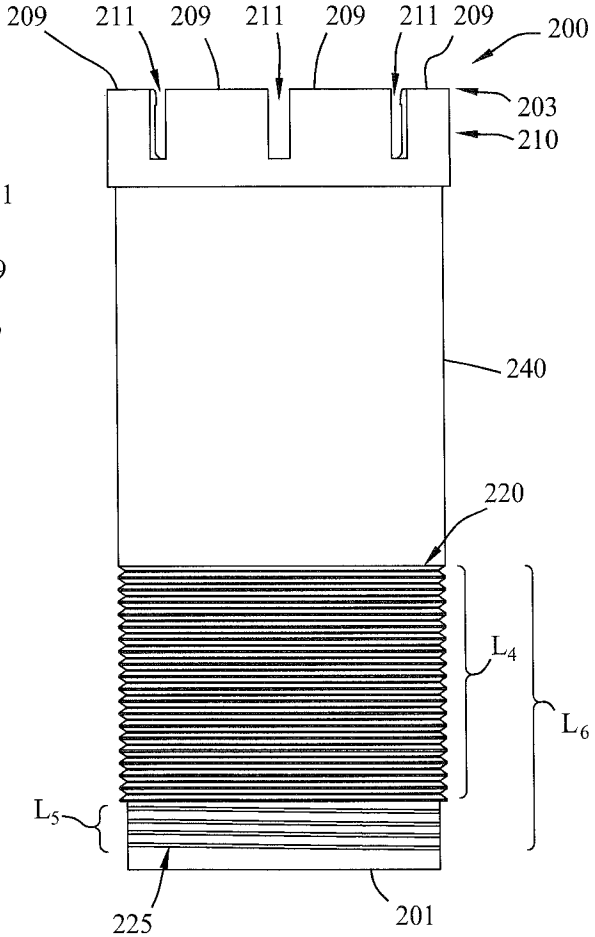
FIG. 3B is a side view of the shotgun choke adapter of FIG. 3A.
Figure 3A:
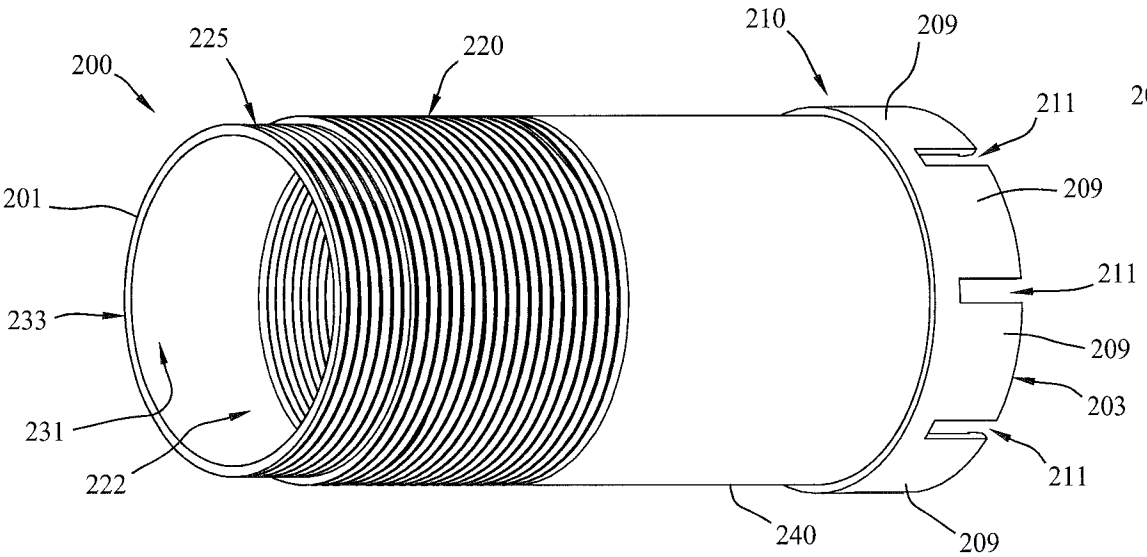
FIG. 3A is a perspective view of the shotgun choke adapter of FIG. 1A.
Figure 3C:
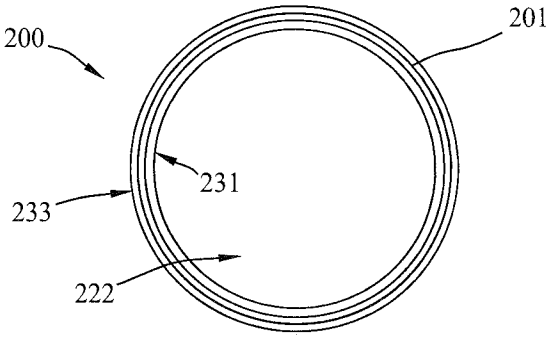
FIG. 3C is an end view of the shotgun choke adapter of FIG. 3A.
Figure 3E:
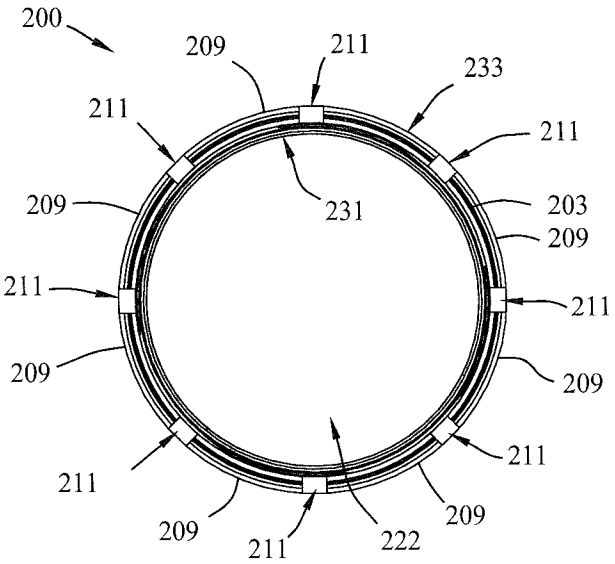
FIG. 3E is another end view of the shotgun choke adapter of FIG. 3A.
Figure 3D:
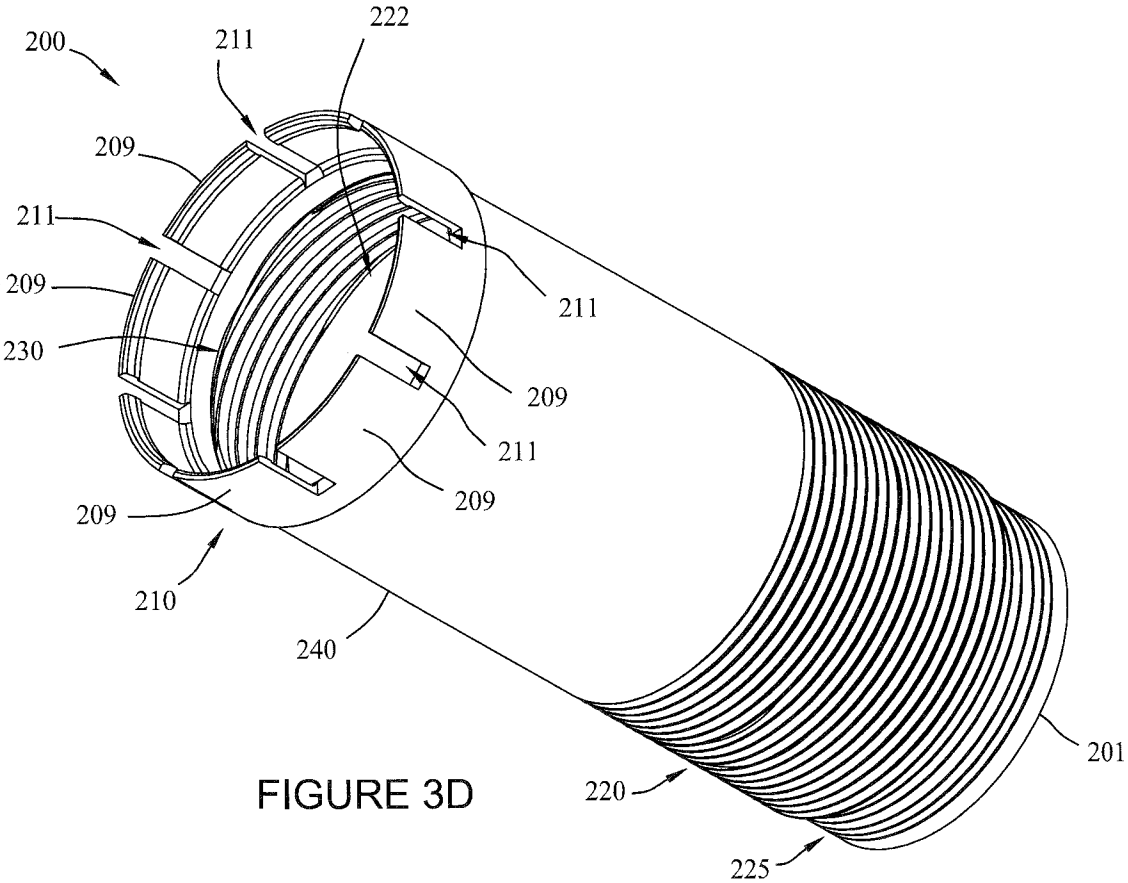
FIG. 3D is another perspective view of the shotgun choke adapter of FIG. 3A.

First tubular 200 includes cosmetic threads 225 on exterior surface 233 thereof. Cosmetic threads 225 are positioned adjacent threads 220, and are designed to aesthetically appear to be integral with and a continuation of threads 220. Thus, cosmetic threads 225 may provide a visual illusion that threads 220 extend over a longer length of first tubular 200 than the actual length of threads 220 on first tubular 200. With reference to FIG. 3B, threads 220 extend along first tubular 200 by distance $L_4$. Cosmetic threads 225 extend along first tubular 200 by distance $L_5$. However, because cosmetic threads 225 are positioned adjacent threads 220 and are designed to aesthetically appear to be integral with and a continuation of threads 220, a user looking at first tubular 200 may believe that first tubular 200 includes threads that extend by distance $L_6$, which is equivalent to $L_4+L_5$ (i.e., $L_4+L_5=L_6$). While threads 220 are of sufficient length to couple with a shotgun barrel therein with sufficient strength to stay coupled therewith during firing of the shotgun, such a visual illusion can instill a sense of confidence in users that threads 220 have sufficient strength to hold first tubular 200 onto a shotgun barrel during use of the shotgun. Cosmetic threads 225 are not functional threads, such that cosmetic threads 225 do not and cannot mate with other threads.

First tubular 200 includes collet 210. While shown as a collet, the first tubular disclosed herein is not limited to being a collet, and may be any structure capable of engaging with knurling on second tubular 300 such that first tubular 200 and second tubular 300 are locked together. As shown, collet 210 is a collet formed on second end 203 of first tubular 200. Collet 210 includes a plurality of collet tabs 209 with collet slots 211 positioned therebetween. Collet 210 is engageable with knurling 310 of second tubular 300, as described in more detail below. While the engagement between the two tubulars is shown as being accomplished via coupling a collet with knurling, in other embodiments a collet is coupled with a locking structure other than a knurling, or knurling is coupled with a locking structure other than a collet.

Shotgun Choke Locking Structure and Threading

Figure 4A:
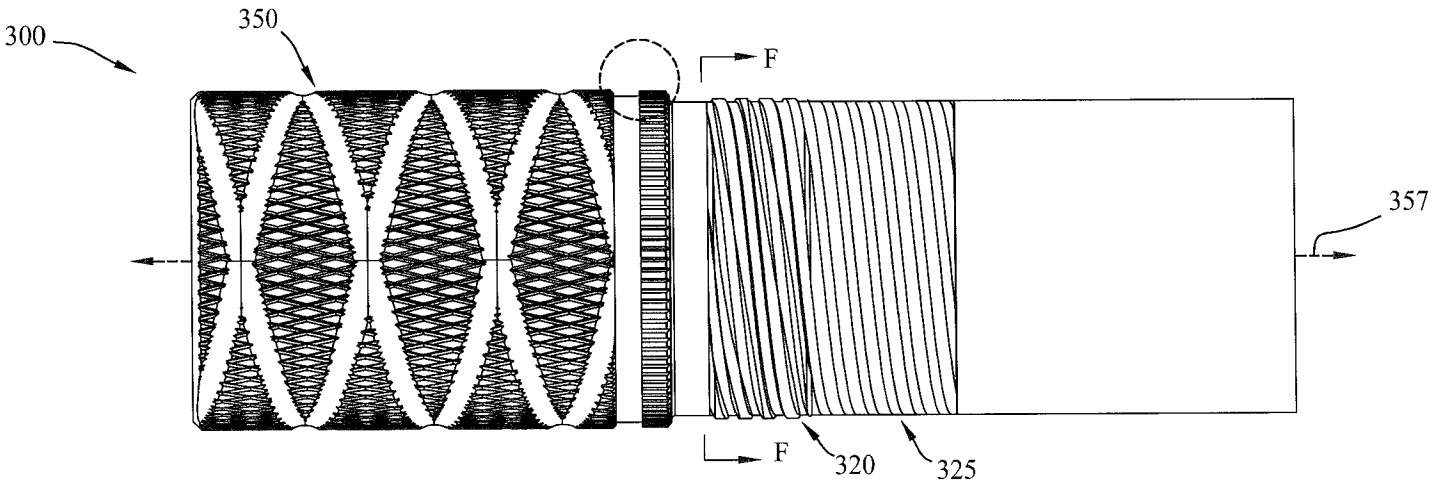
FIG. 4A is a side view of a shotgun choke insert.
Figure 4C:
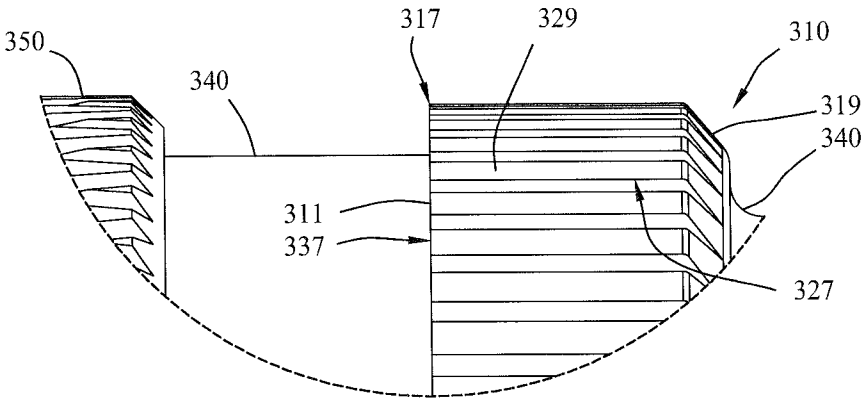
FIG. 4C is a detail view of the shotgun choke insert of FIG. 4A at section I.
Figure 4B:
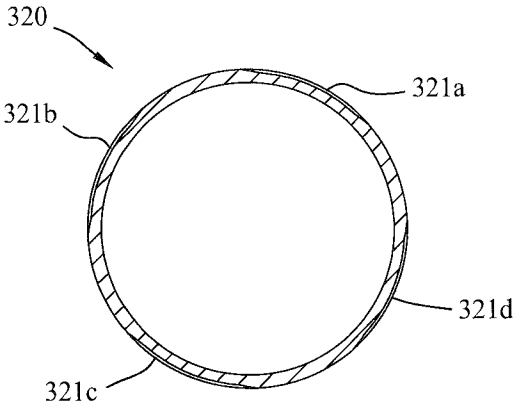
FIG. 4B is a cross-sectional view of the shotgun choke insert of FIG. 4A along line F-F.

FIGS. 4A-4C are additional views of the shotgun choke insert, showing details of the locking structure thereof. Knurling 310 of second tubular 300 includes a plurality of knurls 311 arranged in series about the circumference of second tubular 300. Knurls 311 may be arranged concentrically about a longitudinal central axis 357 of second tubular 300. Spaces or grooves 337 are positioned between each pair of adjacent knurls. Each knurl 311 includes relatively flat, locking surface 317, top surface 329, and ramp 319. Knurls 311 may be relatively straight knurls that extend parallel with axis 357. Knurls 311 may form a ridge about second tubular 300. In operation, knurls 311 frictionally engaged with collet tabs 209 to lock second tubular 300 into place onto first tubular 200. While knurling 310 is shown and described as including a plurality of straight knurls, one skilled in the art would understand that the locking structure may have other configurations adapted to frictionally and/or lockingly engage with a collet. Side edges 327 of each straight knurl 311 are shown as being at right angles relative to top surfaces 329. However, one skilled in the art would understand that side edges 327 and/or top surfaces 329 may be beveled, allowing for collet tabs 209 to more easily move over straight knurls 311 while rotating relative to straight knurls 311 during the mating of threads 230 with threads 320. The locking structure of the second tubular is, of course, not limited to the particular structure shown in FIGS. 4A-4C, and may be another structure capable of locking engagement with a collet on the first tubular.

In some embodiments, threads of the second tubular include a single lead. In other embodiments, threads of the second tubular include multiple leads (i.e., two or more leads), such as four leads. As shown in FIG. 4B, threads 320 of second tubular 300 include four leads 321*a*-321*d*. Each lead 321*a*-321*d* provides a lead to begin the mating of threads 320 with threads 230. In some embodiments, threads 320 have a relatively low pitch (e.g., are relatively course threads). In some such embodiments, the low pitch of threads 320 is four pitch thread. Without being bound by theory, lower pitch threads provide more linear movement with a minimal amount of degrees of rotation in comparison to higher pitch threads. Thus, lower pitch threads, in isolation, require less force (e.g., vibrational force) to become loosened in comparison to higher pitch threads. Having multiple leads provides the ability to screw tubulars together more quickly. For example, in some embodiments, a single 360° or less turn of second tubular 300 relative to first tubular 200 is sufficient to threadably engage first tubular 200 with second tubular 300 and lockingly engage collet tabs 209 with knurls 311. As such, the geometry and surface features (i.e., the shape, size, and arrangement of threads 320, threads 230, collet 210, and knurling 310) provide tubular assembly 100 with the capability of being easily and quickly hand-tightened by a user, without the use of tools, such as wrenches. For example, a user utilizing the shotgun choke embodiment of tubular assembly shown in FIGS. 1A and 1B may be able to quickly and easily change the shotgun choke (i.e., second tubular), such as to adapt to different shooting circumstances (e.g., different distances and/or target types).

In some applications, the tubular assembly and method of assembling tubulars disclosed herein is used for wrench-less connections of tubulars that require additional holding forces without a mechanical lock, such as a key or pin, to keep the tubulars from turning loose from one another. In some such embodiments, the multi-lead thread pitch is sufficiently course that it has little locking power. Course threads produce high helix angles, which are not considered locking angles. Fine threads produce low helix angles, which are considered locking angles. Thus, with a fine pitch thread, a wrench may be used to tighten the associated threaded connection, forming a connection that will hold under high forces. In some such embodiments, the threads of the second tubular are course pitch threads that will not hold, in isolation, under the high forces involved (e.g., forces related to shooting of bullets/shotgun shells from a barrel), even if tightened by a wrench. However, use of a collet and knurling, in conjunction with such course pitch threads, provides for a sufficiently strong connection between the first and second tubulars that such course pitch threads may be used, and will hold under such high forces. In some embodiments, the connection between the first and second tubulars provided by the collet, knurls, and course pitch threads is a sufficiently strong connection to hold under high forces, while also being a connection that is capable of being loosened by hand, without use of a wrench.

Shotgun Insert Locking Structure and Threading

Figure 5C:
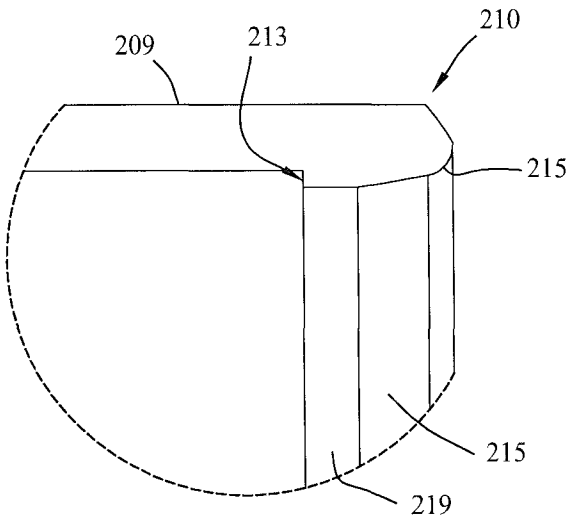
FIG. 5C is a detail view of the shotgun choke adapter of FIG. 5A at section K.
Figure 5A:
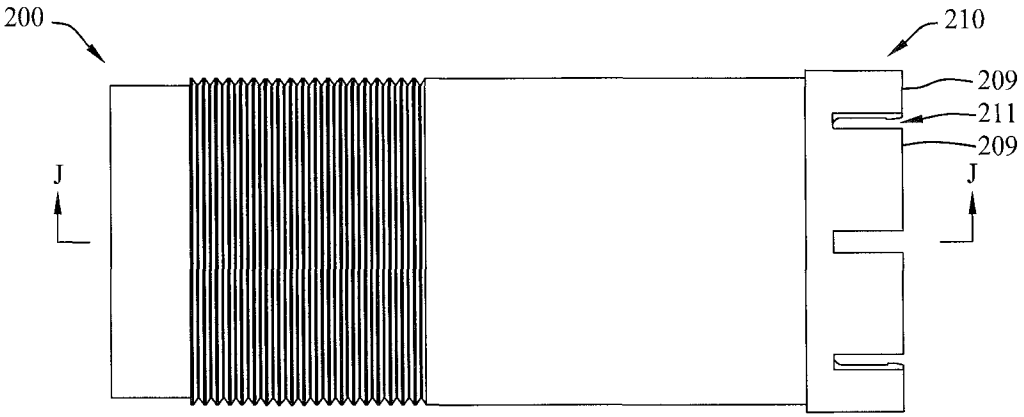
FIG. 5A is a side view of a shotgun choke adapter.
Figure 5B:
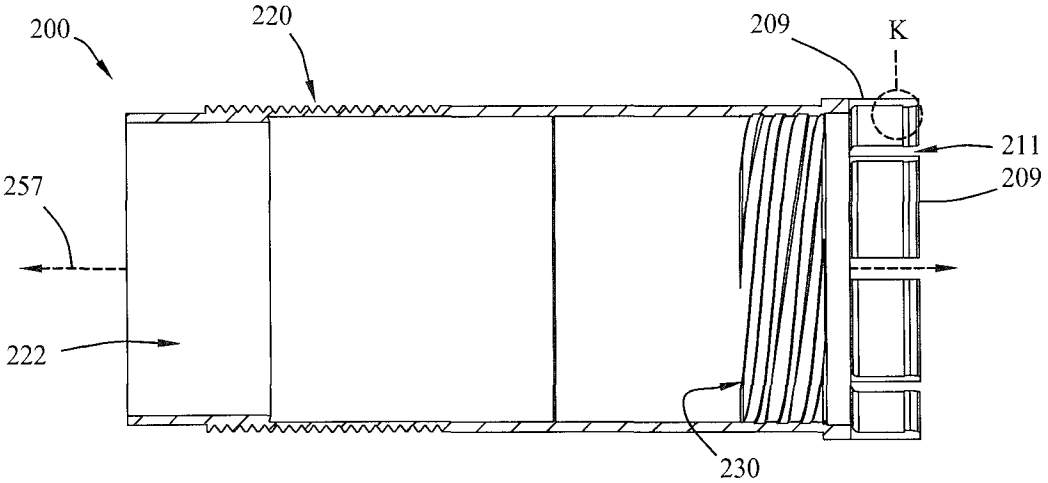
FIG. 5B is a cross-sectional view of the shotgun choke adapter of FIG. 5A along line J-J.
Figure 6A:
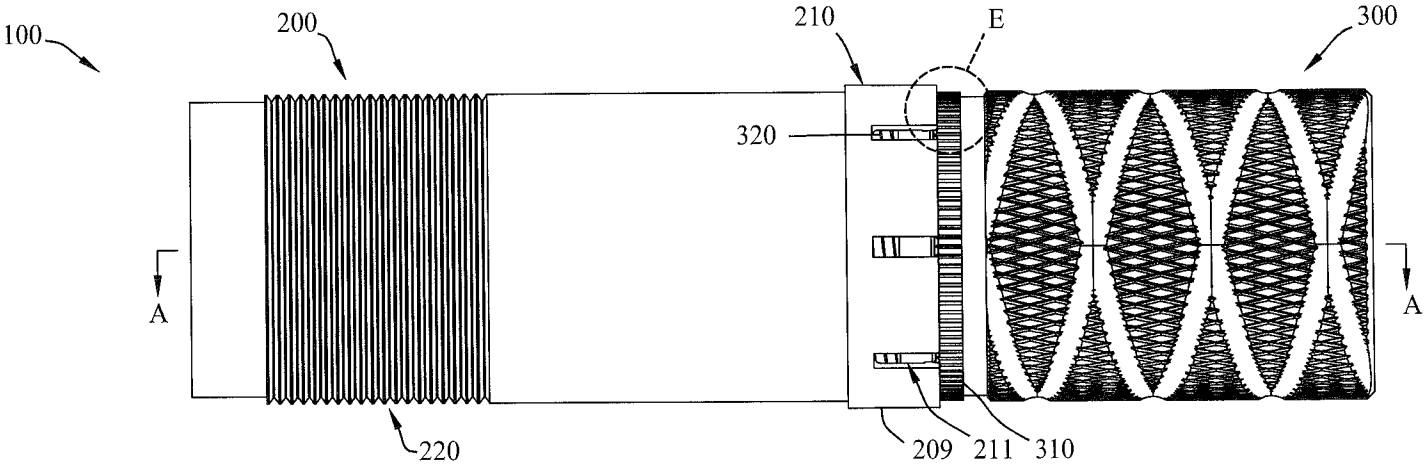
FIG. 6A is a side view of a tubular assembly of a shotgun choke insert with a shotgun choke adapter, partially assembled together.
Figure 6B:
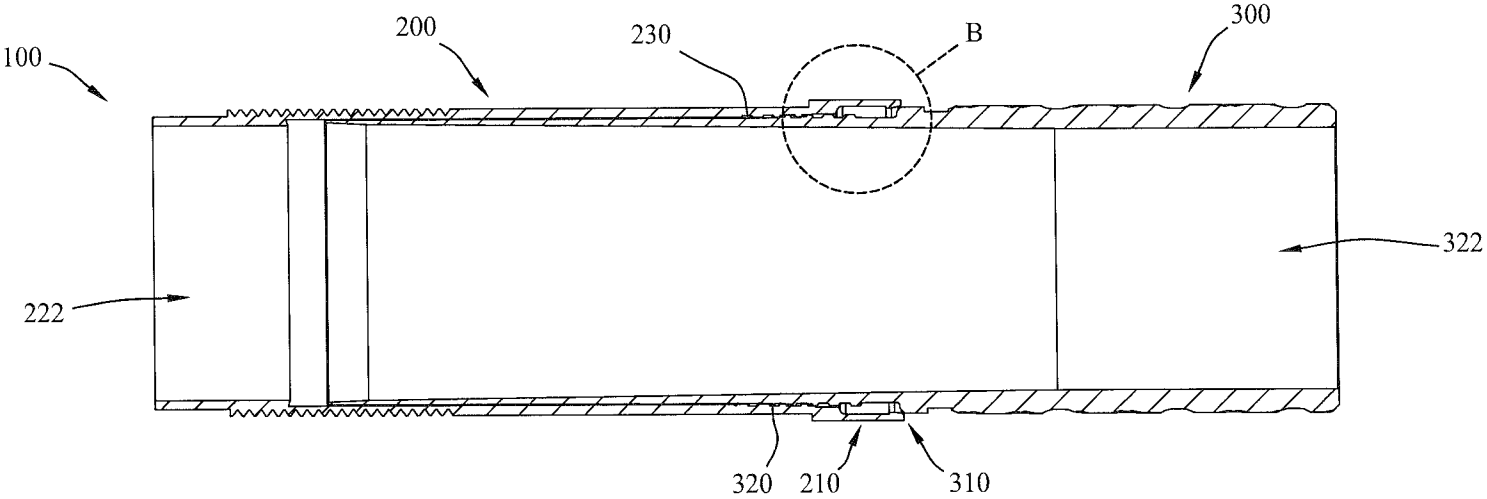
FIG. 6B is a cross-sectional view of the tubular assembly of FIG. 6A, along line A-A.
Figure 6D:
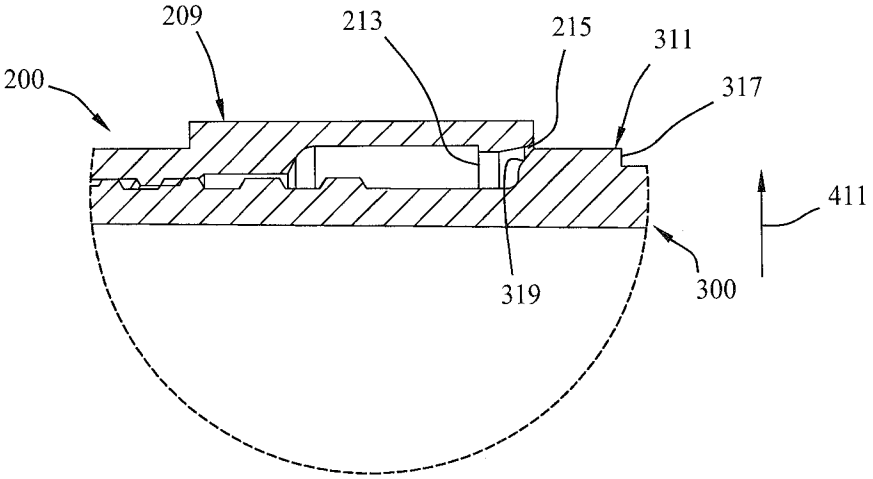
FIG. 6D is a detail view of the tubular assembly of FIG. 6B at section B.
Figure 6C:
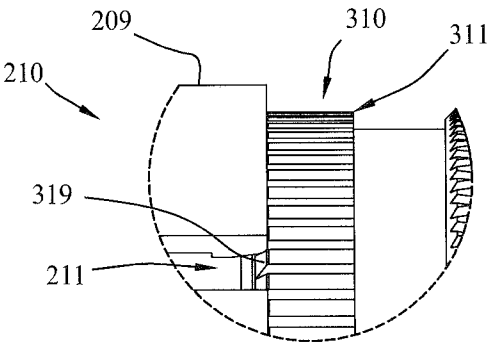
FIG. 6C is a detail view of the tubular assembly of FIG. 6A at section E.
Figure 6E:
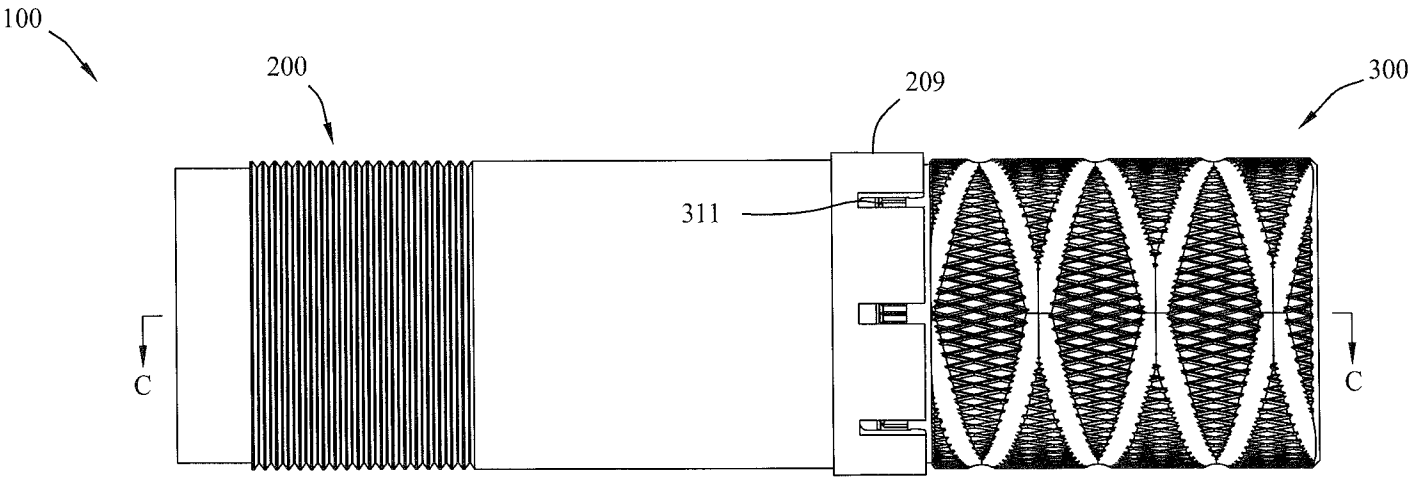
FIG. 6E is a side view of the tubular assembly of FIG. 6A, fully assembled together.
Figure 6F:
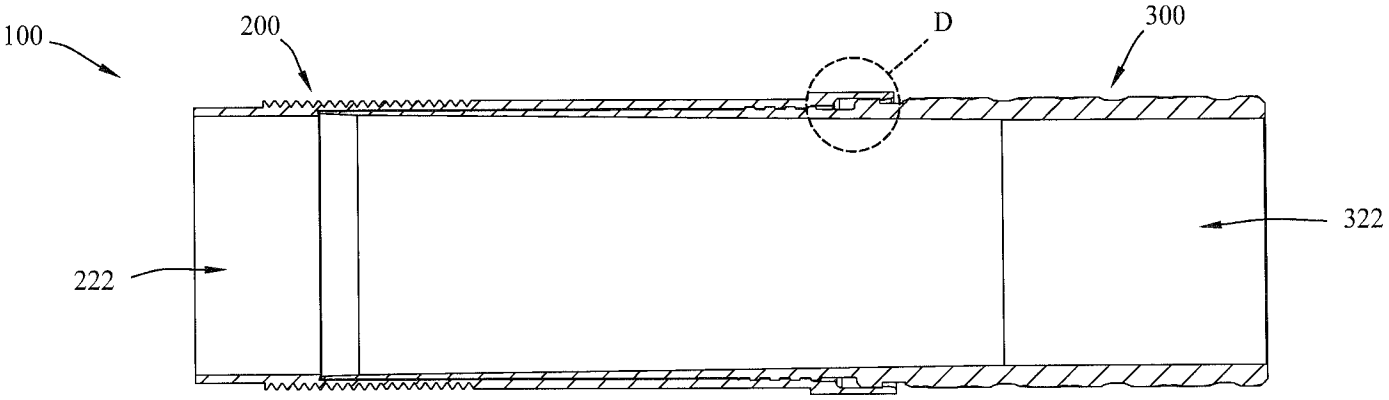
FIG. 6F is a cross-sectional view of the tubular assembly of FIG. 6E along line C-C.
Figure 6G:
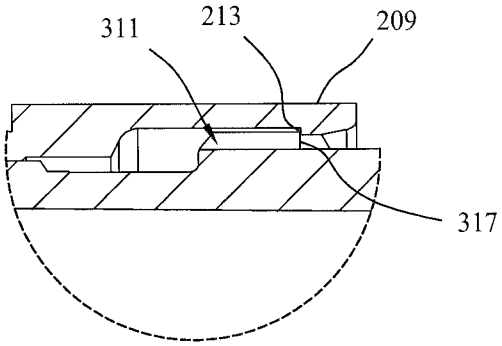
FIG. 6G is a detail view of the tubular assembly of FIG. 6F at section D.

FIGS. 5A-5C are additional views of the shotgun choke adapter, showing details of the locking structure thereof. Collet 210 of first tubular 200 includes a collet, including a plurality of collet tabs 209 arranged in series with slots 211 positioned between each pair of adjacent collet tabs 209. Collet tabs 209 may be arranged concentrically about a longitudinal central axis 257 of first tubular 200. Each collet tab 209 includes a relatively flat, locking surface 213, side surface 219, and one or more ramp surfaces 215. The locking structure of the first tubular is, of course, not limited to the particular structure shown in FIGS. 5A-5C, and may be another structure capable of locking engagement with a knurling on the second tubular.

Engagement Between First and Second Tubulars

With reference to FIGS. 6A-6G, engagement of first tubular 200 and second tubular 300 is described. FIGS. 6A-6D tubular assembly 100 is partially assembled, such that collet 210 is not fully engaged and locked onto knurling 310. Whereas, in FIGS. 6E-6G, tubular assembly 100 is fully assembled such that locking structure is fully engaged with and locked onto knurling 310.

Assembly of first tubular 200 and second tubular 300 to form tubular assembly 100 includes threading second tubular 300 within first tubular 200 by threadably mating threads 320 with threads 230. As first tubular 200 and second tubular 300 are threadably engaged, collet tab 209 moves, progressively, toward knurls 311 until ramp 215 engages with ramp 319. After engagement between ramp 215 and ramp 319, continued threading of second tubular 300 into first tubular 200 causes ramp 215 to slid upwards on ramp 319, resulting in knurls 311 applying force onto collet tabs 209 such that collet tabs 209 are forced upwards, generally in direction 411. Slots 211 of collet 210 allow each individual collet tab 209 to independently move, spring, or flex outwards in direction 411, away from the longitudinal central axis 257 of bore 222, such that collet tabs 209 are forced over knurls 311. This "spring action" of collet tabs 209 allows collet 210 to engage over and lock onto knurling 310. Second tubular 300 is threaded onto first tubular 200 until collet tabs 209 spring back and locking surface 213 is engaged with locking surface 317. In the embodiment shown in FIGS. 6A-6G, locking surface 213 is a flat surface with relatively sharp, squared corners, such that locking surface 213 is at a right angle relative to collet tab side surface 219 (shown in FIG. 6C). Also, locking surface 317 is a flat surface with relatively sharp, squared corners such that locking surface 317 is a right angle relative to knurl top surface 329. Locking surfaces 213 and 317 each extend in a plane that is perpendicular to longitudinal axis of bore holes 222 and 322 when second tubular 300 is inserted within first tubular 200. Thus, first tubular 200 and second tubular 300 each have locking features (i.e., collet and knurls) with locking surfaces that engage one another to provide a secure engagement between tubulars 200 and 300. Once locking surfaces 213 are engaged with locking surfaces 317, first tubular 200 and second tubular 300 are lockingly engaged (i.e., fully assembled). When fully assembled, first bore 222 is in fluid communication with second bore 322 such that, in use, ammunition may pass from a shotgun barrel, into first tubular 200, then into second tubular 300, and the out of second tubular 300.

While the first tubular is shown and described as an adapter for attaching to a gun barrel, in some embodiments, the first tubular disclosed herein is a gun barrel or is an integral portion of a gun barrel.

Quick Connect and Disconnect

In some embodiments, the use of a collet and knurling to lockingly engaged the tubulars provides for a sufficiently secure connection between the tubulars such that a reduced amount of threading (number of screw threads) on threads 230 and 320 are required than would otherwise be required on otherwise identical tubulars lacking the collet and knurls. As such, the use of a collet and knurling provides for a reduced number of turns of the tubulars relative to one another in order to screw the tubulars together. Thus, the locking structures disclosed herein reduce the time and effort required in order to connect two tubulars together in a sufficiently strong manner for use of the tubular assembly in relatively high-force applications, such as firearm applications.

In some embodiments, assembly of the first tubular with the second tubular, by threadably mating the first exterior threads with the first interior threads and lockingly engaging the tubulars, requires less than a three-hundred-and-sixty-degree rotation of the first and second tubulars relative to one another. That is, beginning with the first and second tubulars detached from one another, if the first tubular is maintained static and the second tubular is rotated, the first and second tubulars can be attached to one another by rotating the second tubular by less than a three-hundred-and-sixty-degree rotation. Or, beginning with the first and second tubulars detached from one another, if the second tubular is maintained static and the first tubular is rotated, the first and second tubulars can be attached to one another by rotating the first tubular by less than a three-hundred-and-sixty-degree rotation. As used herein, "lockingly engaged" refers to an engagement between the first and second tubulars where the locking structure of the first tubular is locked onto the locking structure of the second tubular (e.g., the locking surfaces are engaged).

Firearm Suppressor

With reference to FIGS. 7A-8C, a firearm suppressor tubular assembly in accordance with certain embodiments of the present disclosure is depicted. In FIGS. 7A-8C, like reference numerals, relative to those in FIGS. 1-6G, depict like elements. Unless otherwise stated, like elements operate in the same or substantially the same manner as is described above.

Figure 7A:
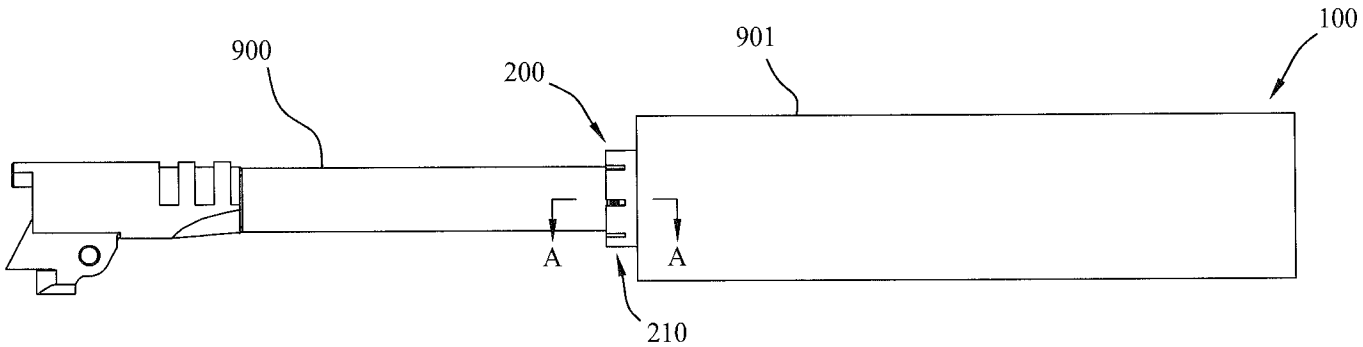
FIG. 7A is a side view of a tubular assembly including a gun barrel, an adaptor, and a suppressor, assembled.
Figure 7B:
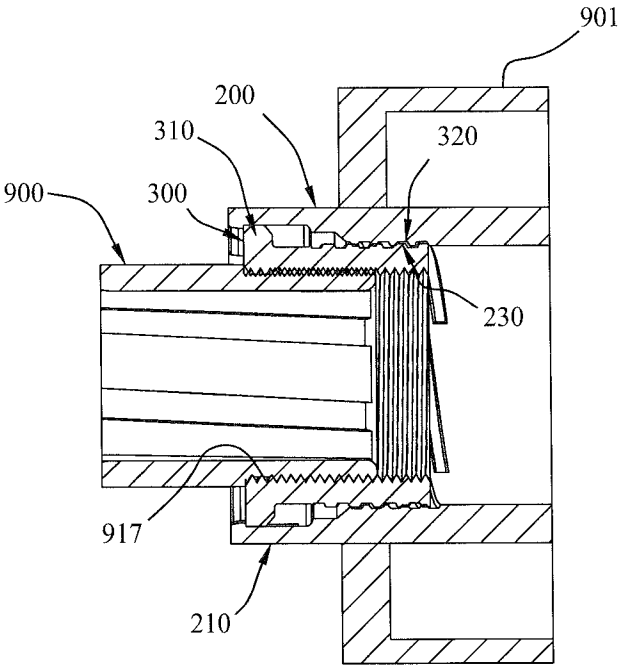
FIG. 7B is a cross-sectional view of the tubular assembly of FIG. 7A along line A-A.
Figure 8A:
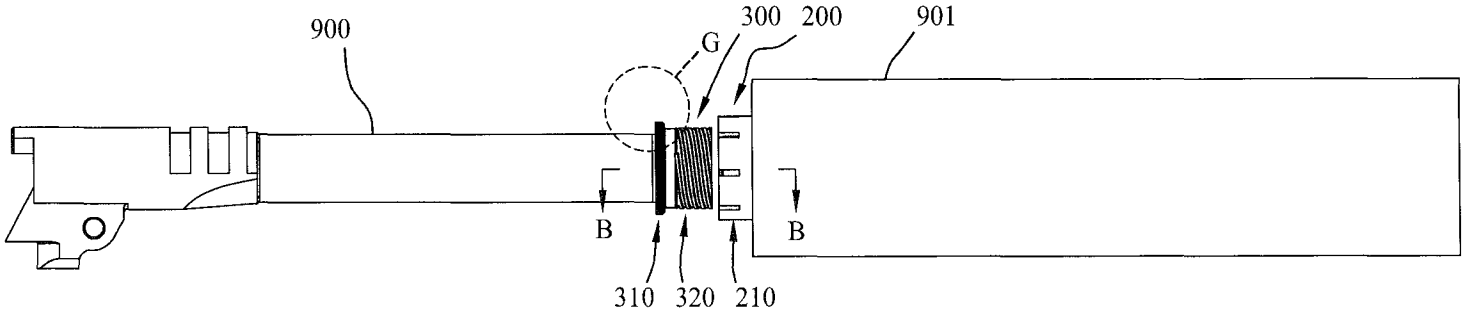
FIG. 8A is a side view of a tubular assembly, including a gun barrel, an adapter, and a suppressor, disassembled.
Figure 8C:
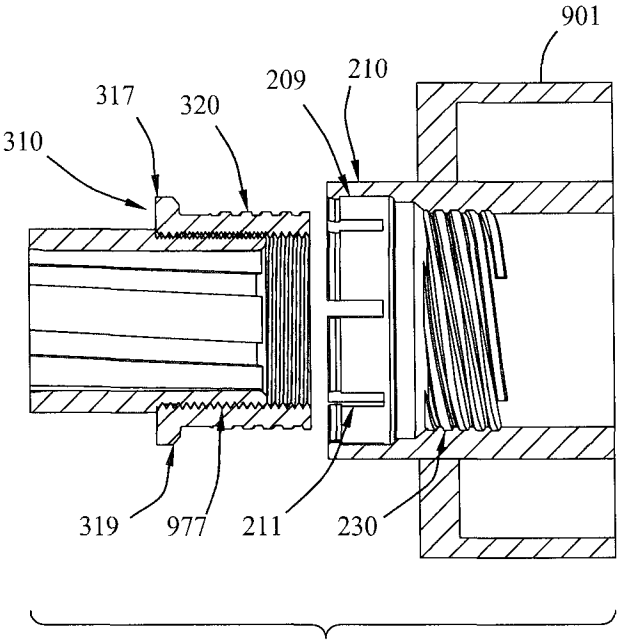
FIG. 8C is a cross-sectional view of the tubular assembly of FIG. 8A along line B-B.
Figure 8B:
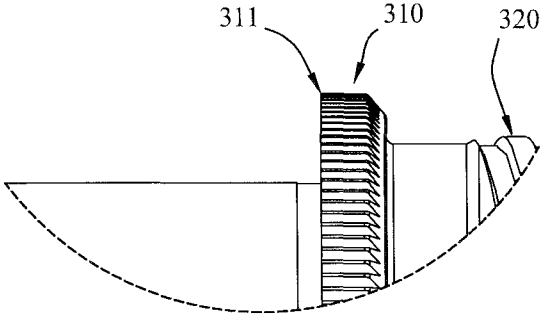
FIG. 8B is a detail view of the tubular assembly of FIG. 8A at section G.

In FIG. 7A, tubular assembly 100 includes first tubular 200 connected with second tubular 300. Second tubular 300 is coupled with gun barrel 900 (e.g., a rifle or pistol barrel). Second tubular 300 is threaded to barrel 900 at threaded connection 977. Second tubular includes threads 320, which are threadably engageable with threads 230 of first tubular 200 in the same manner as described above. First tubular 200 includes collet 210, including collet tabs 209 and slots 211, which are the same or substantially the same as those described with respect to FIGS. 1A-6G. Second tubular 300 includes knurling 310, including knurls 311, locking surface 317, and ramp 319, which are the same or substantially the same as those described with respect to FIGS. 1A-6G. When first tubular 200 and second tubular 300 are threadably coupled, knurling 310 is lockingly engaged with collet 210 in the same or substantially the same manner as described with reference to FIGS. 1A-6G. In the embodiment shown in FIGS. 7A-8C, first tubular 200 is, or is a portion of, a suppressor, and second tubular 300 is a structure that couples with barrel 900 such that barrel 900 (e.g., or a barrel of a rifle or pistol) via threaded engagement 977. In operation, ammunition passes through barrel 900, through or past second tubular 300, and through and out of first tubular 200. Thus, the tubular assembly disclosed herein may be used to attached suppressors to firearms.

In the embodiment shown in FIGS. 7A-8C, the first tubular having the collet is a suppressor 901, or a portion of a suppressor 901, and the second tubular having the ridge of knurls is an adaptor that adapts the gun barrel for coupling with the suppressor 901. However, one skilled in the art would understand that the second tubular having the ridge of knurls may be a suppressor, or a portion of a suppressor, and the first tubular having the collet may be an adaptor that adapts the gun barrel for coupling with the suppressor. Also, in some embodiments, the components of the adapter are integral with the barrel (as opposed to being attached thereto), such that the suppressor can be coupled directly to the barrel.

Method of Assembling Tubulars

Some embodiments of the present disclosure include a method of assembling tubulars. The method may be implemented using any tubulars in accordance with the present disclosure, including tubular assemblies described with reference to FIGS. 1A-8C.

The method includes threadingly engaging the two tubulars tubular together at least until a collet on one of the tubulars is frictionally engaged with knurling on the other tubular.

In some embodiments, the method reduces the number of turns required for attaining a sufficiently strong connection between tubulars, and reduces the time required for attaining a sufficiently strong connection between tubulars. In some embodiments, the tubulars are threaded together by hand, without use of a wrench or other tool.

In embodiments of the method in which tubular assembly 100 in accordance with FIG. 1A-6G or 7A-8C is used, the method includes inserting the second tubular into a bore of the first tubular, and mating threads 230 with threads 320. While mating threads 230 with threads 320, collet ramp 215 engages ramp 319, forcing collet tabs 209 to flex outward such that collet tabs 209 engage over top surface 329 of the straight knurls of knurling 310. Slots 211, in part, allow for the flexing of collet tabs 209. As the mating of threads 230 with threads 320 continues, collet tabs 209 rotate about the top surface 329 of straight knurls, which may produce an audible clicking sound. After locking surface 213 of collet tabs 209 reaches locking surface 317 of knurling 310, collet tabs 209 spring back (flex inward) such that locking surfaces 317 and 213 are engaged with one another, and first tubular 200 and second tubular 300 are frictionally and/or lockingly engaged together as tubular assembly 100.

While the coupling between the tubulars is shown and described as including threaded coupling, the tubular assemblies disclosed herein are not limited to being threadably coupled. Also, in some embodiments, one of the tubulars of the tubular assembly is a barrel of a gun that includes one of the collet or knurling as an integral part thereof, such that the other tubular is coupled directly with the gun barrel without an insert or adapter therebetween.

EMBODIMENTS

Certain embodiments will now be described.

Embodiment 1

A tubular assembly, the assembly comprising: a first tubular comprising: an interior surface, an exterior surface, a first end, and a second end, wherein the interior and exterior surfaces at least partially define a bore through the first tubular extending from the first end to the second end; first interior threads on the interior surface of the first tubular; and a collet on the first end of the first tubular; a second tubular, the second tubular comprising: an interior surface, an exterior surface, a first end, and a second end, wherein the interior and exterior surfaces at least partially define a bore through the second tubular extending from the first end to the second end; first exterior threads on the exterior surface of the second tubular; and a locking structure on the exterior surface of the second tubular; wherein, when the first tubular and the second tubular are assembled, the first exterior threads are threadably mated with the first interior threads and the collet is engaged with the locking structure.

Embodiment 2

The tubular assembly of embodiment 1, wherein the locking structure comprises a ridge on the exterior surface the second tubular.

Embodiment 3

The tubular assembly of embodiment 2, wherein the ridge comprises a plurality of knurls.

Embodiment 4

The tubular assembly of embodiment 2 or 3, wherein the ridge comprises a locking surface, wherein the collet comprises tabs with locking surfaces, and wherein when the first tubular and the second tubular are assembled, the locking surfaces of the collet are engaged with the locking surface of the ridge.

Embodiment 5

The tubular assembly of embodiment 3, wherein, when the first tubular and the second tubular are assembled, the knurls are frictionally engaged with the collet.

Embodiment 6

The tubular assembly of any of embodiments 1 to 5, wherein the first tubular comprises second exterior threads on the exterior surface thereof, and wherein the second exterior threads are threadably mateable with a gun barrel.

Embodiment 7

The tubular assembly of any of embodiments 1 to 5, wherein the second tubular comprises second interior threads on the interior surface thereof, and wherein the second interior threads are threadably mateable with a gun barrel.

Embodiment 8

The tubular assembly of any of embodiments 1 to 7, wherein the first tubular includes first cosmetic threads on the interior surface thereof adjacent the first interior threads.

Embodiment 9

The tubular assembly of any of embodiments 1 to 8, wherein the second tubular includes second cosmetic threads on an exterior surface thereof adjacent the first exterior threads.

Embodiment 10

The tubular assembly of any of embodiments 1 to 9, wherein the first exterior threads of the second tubular are multi-lead threads.

Embodiment 11

The tubular assembly of any of embodiments 1 to 10, wherein the first interior threads of the first tubular are multi-lead threads.

Embodiment 12

The tubular assembly of any of embodiments 1 to 11, further comprising a gripping surface on a body of the second tubular.

Embodiment 13

The tubular assembly of embodiment 12, wherein the gripping surface comprises knurling.

Embodiment 14

The tubular assembly of any of embodiments 1 to 5 and 8 to 13, wherein the tubular assembly is an assembly of a shotgun choke adapter with a shotgun choke insert, wherein the first tubular is the shotgun choke adapter and the second tubular is the shotgun choke insert, and wherein the shotgun choke insert is engageable with a shotgun barrel.

Embodiment 15

The tubular assembly of any of embodiments 1 to 5 and 8 to 13, wherein the tubular assembly is an assembly of a firearm suppressor with a barrel adapter, wherein the first tubular is the firearm suppressor and the second tubular is the barrel adapter, and wherein the barrel adapter is engageable with a gun barrel.

Embodiment 16

The tubular assembly of any of embodiments 1 to 5 and 8 to 13, wherein the first tubular is a gun barrel or a portion of a gun barrel.

Embodiment 17

The tubular assembly of any of embodiments 1 to 5 and 8 to 13, wherein the second tubular is a gun barrel or a portion of a gun barrel.

Embodiment 18

The tubular assembly of any of embodiments 1 to 17, wherein assembly of the first tubular with the second tubular by threadably mating the first exterior threads with the first interior threads and lockingly engaging the collet with the locking structure requires less than a three-hundred-and-sixty-degree rotation of the first and second tubulars relative to one another.

Embodiment 19

A shotgun and shotgun choke assembly, the assembly comprising: a shotgun having a barrel, the barrel comprising threads on an interior surface of the barrel, and a collet on a muzzle of the barrel; a shotgun choke comprising: an interior surface, an exterior surface, a first end, and a second end, wherein the interior and exterior surfaces at least partially define a bore through the shotgun choke extending from the first end to the second end; first exterior threads on the exterior surface of the shotgun choke; and a ridge comprising a plurality of knurls on the exterior surface of the shotgun choke; wherein, when the barrel and the shotgun choke are assembled, the first exterior threads are threadably mated with the threads on the barrel and the collet is engaged with the ridge.

Embodiment 20

A gun and suppressor assembly, the assembly comprising: a gun comprising a barrel, the barrel comprising threads on an exterior surface of the barrel, and a ridge on a muzzle of the barrel, the ridge comprising a plurality of knurls; a suppressor, the suppressor comprising an interior surface, an exterior surface, a first end, and a second end, wherein the interior and exterior surfaces at least partially define a bore through the suppressor extending from the first end to the second end, a collet on the first end of the suppressor, and interior threads on the interior surface of the suppressor; wherein, when the suppressor and the barrel are assembled, the threads of the barrel are threadably mated with the threads of the suppressor, and the collet is engaged with the ridge.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A shotgun choke, the shotgun choke comprising:
a shotgun choke adapter comprising:
a bore extending from a first end to a second end of the shotgun choke adapter; and
a collet on the first end of the shotgun choke adapter, wherein the collet has a first locking surface thereon;
a shotgun choke insert, the shotgun choke insert comprising:
a bore extending from a first end to a second end of the shotgun choke insert; and
a second locking surface on the shotgun choke insert;
wherein the shotgun choke insert is threadably mateable with the shotgun choke adapter such that the first locking surface extends, along a longitudinal centerline of the shotgun choke, past the second locking surface such that the first locking surface is lockingly engaged with the second locking surface; and
wherein the second end of the shotgun choke adapter is configured to couple with a barrel of a shotgun.

2. The shotgun choke of claim 1,
wherein the shotgun choke adapter comprises:
an interior surface and an exterior surface, wherein the interior and exterior surfaces at least partially define the bore through the shotgun choke adapter; and
first interior threads on the interior surface of the shotgun choke adapter; and
where the shotgun choke insert comprises:
an interior surface and an exterior surface, wherein the interior and exterior surfaces at least partially define the bore through the shotgun choke insert;
first exterior threads on the exterior surface of the shotgun choke insert; and
wherein the second locking surface is on the exterior surface of the shotgun choke insert;
wherein the first exterior threads are threadably mateable with the first interior threads such that the first locking surface of the collet extends past, along the longitudinal centerline, the second locking surface such that the first locking surface is lockingly engaged with the second locking surface.

3. The shotgun choke of claim 1, wherein the shotgun choke insert comprises a ridge, wherein the second locking surface is a surface of the ridge, and wherein the shotgun choke insert is threadably mateable with the shotgun choke adapter such that the first locking surface extends, along the longitudinal centerline of the shotgun choke, past the ridge and past the second locking surface such that the first locking surface is lockingly engaged with the second locking surface.

4. The shotgun choke of claim 3, wherein the ridge comprises a plurality of knurls.

5. The shotgun choke of claim 3, wherein the collet comprises tabs, each tab having one of a plurality of the first locking surfaces thereon, and wherein the plurality of first locking surfaces of the collet are lockingly engagable with the second locking surface of the ridge.

6. The shotgun choke of claim 4, wherein the knurls are frictionally engagable with the collet.

7. The shotgun choke of claim 2, wherein the shotgun choke adapter comprises second exterior threads on the exterior surface thereof, and wherein the second exterior threads are threadably mateable with a barrel of a shotgun.

8. The shotgun choke of claim 2, wherein the shotgun choke insert comprises second interior threads on the interior surface thereof, and wherein the second interior threads are threadably mateable with a barrel of a shotgun.

9. The shotgun choke of claim 2, wherein the shotgun choke adapter includes first cosmetic threads on the interior surface thereof adjacent the first interior threads.

10. The shotgun choke of claim 2, wherein the shotgun choke insert includes second cosmetic threads on an exterior surface thereof adjacent the first exterior threads.

11. The shotgun choke of claim 2, wherein the first exterior threads of the shotgun choke insert are multi-lead threads.

12. The shotgun choke of claim 2, wherein the first interior threads of the shotgun choke adapter are multi-lead threads.

13. The shotgun choke of claim 1, further comprising a gripping surface on a body of the shotgun choke insert.

14. The shotgun choke of claim 13, wherein the gripping surface comprises knurling.

15. The shotgun choke of claim 1, wherein threadably mating the shotgun choke insert with the shotgun choke adapter such that the first locking surface extends, along the longitudinal centerline of the shotgun choke, past the second locking surface such that the first locking surface is lockingly engaged with the second locking surface requires less than a three-hundred-and-sixty-degree rotation of the shotgun choke insert first and second tubulars relative to the shotgun choke adapter.

16. The shotgun choke of claim 1, wherein the shotgun choke adapter is attachable to a gun barrel of a shotgun such that ammunition expelled from the barrel passes through the shotgun choke.

17. The shotgun choke of claim 1, wherein the locking surfaces are flat surfaces, wherein the longitudinal centerline of the shotgun choke intersects, at a point, a theoretical plane in which the first locking surface resides, and wherein the longitudinal centerline of the shotgun choke intersects, at a point, a theoretical plane in which the second locking surface resides.

18. A firearm suppressor assembly, the firearm suppressor assembly comprising:

a barrel adapter comprising:

a bore extending from a first end to a second end of the barrel adapter; and a collet on the first end of the barrel adapter, wherein the collet has a first locking surface thereon;

a firearm suppressor, the firearm suppressor comprising:

a bore extending from a first end to a second end of the firearm suppressor; and a second locking surface on the firearm suppressor;

wherein the firearm suppressor is threadably matable with the barrel adapter such that the first locking surface extends, along a longitudinal centerline of the firearm suppressor assembly, past the second locking surface such that the first locking surface is lockingly engaged with the second locking surface; and wherein the second end of the barrel adapter is configured to couple with a barrel of a firearm.

19. The firearm suppressor assembly of claim 18, wherein the barrel adapter comprises:

an interior surface and an exterior surface, wherein the interior and exterior surfaces at least partially define the bore through the barrel adapter; and first interior threads on the interior surface of the barrel adapter; and wherein the firearm suppressor comprises:

an interior surface and an exterior surface, wherein the interior and exterior surfaces at least partially define the bore through the firearm suppressor;

first exterior threads on the exterior surface of the firearm suppressor;

wherein the second locking structure is on the exterior surface of the firearm suppressor;

wherein the first exterior threads are threadably mateable with the first interior threads such that the first locking surface of the collet extends past, along the longitudinal centerline, the second locking surface such that the first locking surface is lockingly engaged with the second locking surface.

* * * * *